United States Patent [19]

Jünemann

[11] Patent Number: 4,643,115

[45] Date of Patent: Feb. 17, 1987

[54] WORKPIECE HOLDER FOR SEWING THE TIP AREA OF NECKTIES

[75] Inventor: Hubert Jünemann, Bielefeld, Fed. Rep. of Germany

[73] Assignee: Kochs Adler, AG, Fed. Rep. of Germany

[21] Appl. No.: 847,160

[22] Filed: Apr. 2, 1986

[30] Foreign Application Priority Data

Apr. 4, 1985 [DE] Fed. Rep. of Germany ..... 3512358

[51] Int. Cl.[4] ..... D05B 23/00

[52] U.S. Cl. ..... 112/121.22; 112/121.12

[58] Field of Search ..... 112/121.11, 121.12, 112/121.15, 121.22

[56] References Cited

U.S. PATENT DOCUMENTS 3,405,670 10/1968 Scholl et al. ..... 112/121.12
3,930,454 1/1976 Perlino ..... 112/121.12
4,574,717 3/1986 Junemann et al. ..... 112/121.22

FOREIGN PATENT DOCUMENTS 2110256 6/1983 United Kingdom ..... 112/121.22
2139655 11/1984 United Kingdom ..... 112/121.22

*Primary Examiner*—Ronald Feldbaum
*Attorney, Agent, or Firm*—Laff, Whitesel, Conte & Saret

[57] ABSTRACT

A workpiece holder for sewing the tip areas of neckties comprises a lower plate and a central folding device between which a lining cut and a necktie material cut are arranged. The center folding device has folding plates which can be displaced transversely with respect to the longitudinal direction and which, when moving together, draw in the material fullness in the necktie cut and gather it in a central fold. Lateral seams are sewn after the sewing of outer seams in the tip area of the cuts. In order to achieve a parallel retraction of the outer seams on the finished necktie, there is arranged between the lower plate and center folding device a longitudinal displacing device which comprises a clamping plate for clamping the lining cut on the lower plate and a longitudinal sliding plate which is displaceable towards the lower plate and by means of which, following the sewing of the outer seams, the material fullness of the necktie cut gathered in the central fold is drawn out in such a manner that the outer seams undergo parallel retraction.

11 Claims, 13 Drawing Figures

II
III
IV
a
b

WORKPIECE HOLDER FOR SEWING THE TIP AREA OF NECKTIES

FIELD OF THE INVENTION

The invention relates to a workpiece holder for sewing the area of a tip of a necktie, comprising a lower plate as a support for a lining cut; and comprising a centre folding device to be supported on a necktie material cut to be arranged above the lining cut, the centre folding device having two folding plates which can be adjusted in opposite directions to one another and transversely with respect to a longitudinal direction of the cuts and by means of which a material fullness of the necktie material cut can be drawn into a gap between the folding plates to form a central fold, and the centre folding device being pivotable upwardly from the lower plate or towards the lower plate, and the two cuts being connectable to one another, when the central fold is gathered, by means of two outer seams extending towards the tip and by means of two lateral seams following these outer seams.

BACKGROUND OF THE INVENTION

When sewing the tip area of neckties it is important that the seam between the lining cut and necktie material cut is not arranged, that is so as to be visible, on that edge of the necktie associated with the tip area, but undergoes a so-called retraction. This means that this seam or the two outer seams starting from the actual tip of the necktie on the lining side, i.e. the underside, of the necktie are set back in relation to the outer edge of the necktie. When the cuts are guided manually during necktie sewing, a central fold is formed in the necktie material. Then the outer seams are sewn. During subsequent sewing of the lateral seams, the material fullness of the necktie cut gathered together in the central fold is drawn out continuously. In this way a skilled sewer can ensure that, after the final sewing even of the lateral seams and the turning of the sewn-together cuts, the outer seams run parallel to the corresponding outer edges starting from the tip of the necktie.

A workpiece holder of the type as defined above is described in a publication of the Dürkopp Werke GmbH, Bielefeld/Federal Repubulic of Germany, "Schablonengesteuertes Nühaggregat zur Fertigung von Kleinteilen, Dürkopp 739" (Template-controlled sewing unit for the production of small articles, Dürkopp 739). In this arrangement the lining cut and the necktie material cut are laid on the lower plate, one lying on top of the other; then, the centre folding device with extended folding plates is lowered on to the cuts. The folding plates are subsequently moved towards one another, the so-called material fullness of the necktie material cut being gathered into the gap between the folding plates to form the central fold. Then the outer seams, i.e. the seams starting from the actual tip, and subsequently the lateral seams which extend substantially in the longitudinal direction of the necktie are sewn. After the sewn-together cuts are turned, the outer seams do not run parallel to the necktie edges starting from the tip, but are tapered. This is undesirable because the impression of a skilled and neat piece of work is not achieved.

German Offenlegungsschrift No. 32 37 034 (corresponding to published British Patent Application No. 81 35 414 and published British Patent Application No. 82 14 345) discloses a template for sewing tips of neckties wherein a lower plate is provided with a pivotable upper plate, between which plates the cuts are inserted. A gathering foot is placed between the lining cut and necktie material cut, this foot having upwardly projecting gathering ribs which extent through corresponding recesses in the upper plate. The material fullness of the necktie cut is drawn through in the area of the lower tip and in the area of the lateral corners. An even and flat distribution of this material fullness after the sewing of the outer seams and lateral seams is impossible so that the necktie material does not lie flat after the necktie is turned; therefore, similarity to the manual production of neckties is not achieved.

SUMMARY OF THE INVENTION

It is one object of the invention to design a workpiece holder of the defined type in such a manner that parallel retraction of the outer seams between the necktie material and lining material in the tip area of the necktie is achieved.

This problem is solved by arranging between the lower plate and the centre folding device a longitudinal displacing device with a longitudinal sliding plate, between which plate and the centre folding device the necktie material cut is to be arranged and wherein the longitudinal displacing device is displaceable after the sewing of the outer seams and before the sewing of the lateral seams, while the central fold is drawn out of the gap and outer folds are formed parallel to the outer seams. The features according to the invention make it possible for the material fullness of the necktie material to be drawn out of the central fold and smoothed out by means of the sliding plate of the longitudinal displacing device after the outer seams are sewn. Therefore, the retraction of the outer seams is already achieved before the lateral seams are sewn, that is in such a manner as to achieve a parallel retraction.

When the longitudinal displacing device has a clamping plate below the longitudinal sliding plate for clamping the lining cut to the lower plate, the lining cut remains firmly clamped on the lower plate during displacement of the sliding plate after the outer seams are sewn. In this case it is advantageous when the clamping plate can be clamped against the lower plate by means of a clamping device arranged below this lower plate. Because clamping of the clamping plate and lower plate is effected only temporarily, the clamping device is provided with retaining heads. In this case suction heads, for example, can be provided as retaining heads. A design having magnets results however in a particularly simple control particularly since the position of the lining material is not affected by magnets. If the magnets are in the form of permanent magnets, then the clamping device is designed to be movable towards the lower plate.

The surface clamping of the clamping plate and lower plate results in the clamping plate and thus the whole longitudinal displacing device being virtually free from lateral or transverse power so that it can have an extremely thin design. This leads in turn to the advantage that the material fullness of the necktie cut is not fitted in the area of the seams which are to be produced.

If clamping is effected by means of magnets, the longitudinal sliding plate is made of non-magnetic material, which results in the longitudinal sliding plate being displaceable relative to the clamping plate without virtually any friction occurring.

In order to enable, on the other hand, pivoting of the centre folding device together with the longitudinal displacing device into a raised position and to enable, on the other hand, the centre folding device to be swung upwardly into a position for loading the workpiece holder or for removing the sewn workpiece, the centre folding device can be swung upwardly into two positions, and the centre folding device can be swung upwardly towards at least one adjustable swing stop.

Other objects, advantages and features of the present invention will appear from the detailed description of the preferred embodiment, which now will be explained in conjunction with accompanying drawings.

DESCRIPTION OF THE PREFERRED EMBODIMENTS

Figure 1:
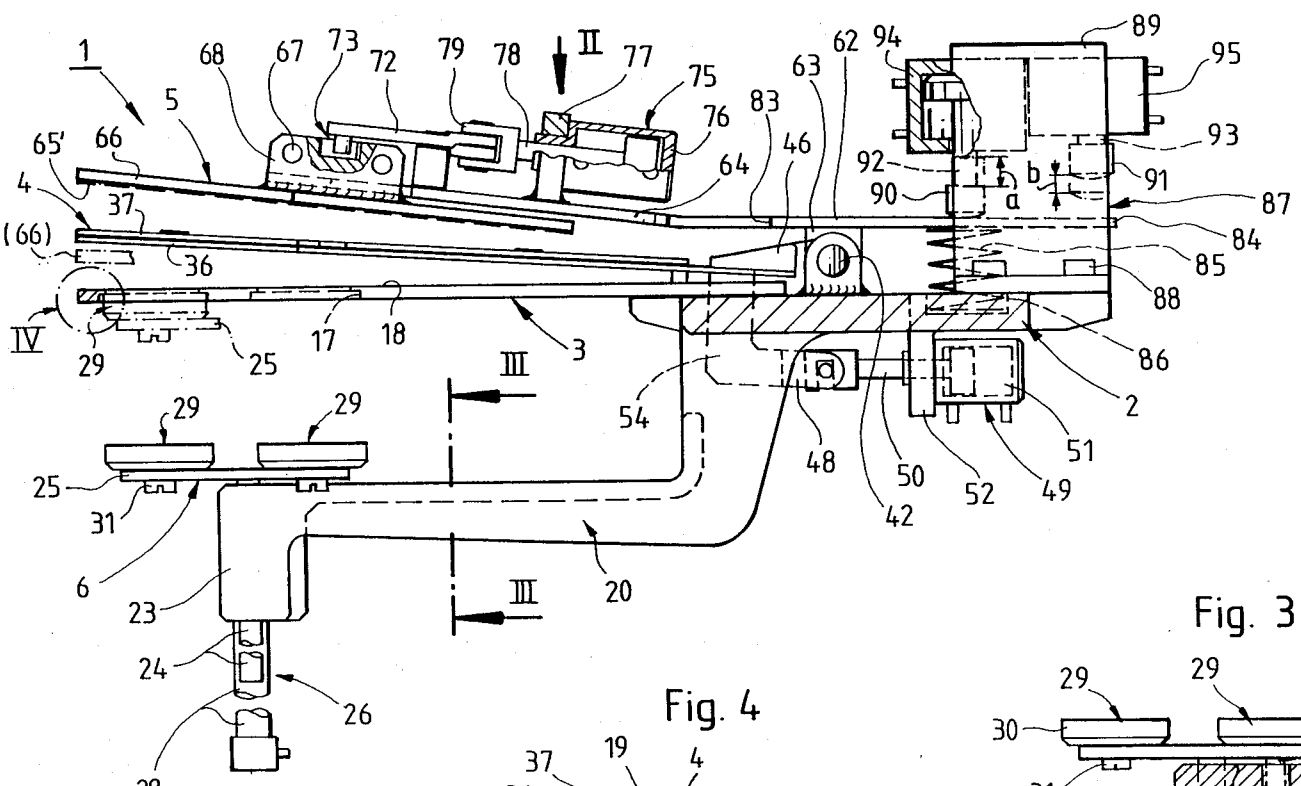
FIG. 1 is a side view of a workpiece holder in an open position, substantially comprising a magnet closing device, a lower plate, a longitudinal displacing device and a centre folding device.

The workpiece holder 1 shown in the drawing is mounted on a carrier 2 which can be supported and drivably guided in the usual manner associated with automatic sewing devices. A lower plate 3, a longitudinal displacing device 4 and a centre folding device 5 are attached to the carrier 2.

A clamping device 6 is also attached to the carrier 2 below the lower plate 3.

The lower plate 3 has a basic shape corresponding approximately to the tip area of the necktie which is to be sewn. This tip area is generally symmetrically shaped, but can also be asymmetrical in design. The exemplary embodiment is based on a symmetrical design, i.e. it has a mirror-symmetrical structure relative to an axis of symmetry 7 towards which two outer edges 8, 9 extend and intersect at a point or tip 10 on the axis of symmetry 7. The other ends of the two outer edges 8, 9 each terminate in lateral corners 11, 12 where these outer edges 8, 9 intersect with lateral edges 13, 14 of the lower plate 3. The end of the lower plate 3 adjacent to the carrier 2 has two spaced lugs 15 which are fastened to the carrier 2 by means of screws 16. In the area of the tip 10 and the lateral corners 11, 12 there are formed, in the lower plate 3, circular recesses 17 which have an inwardly drawn edge 19 towards the upper side 18 of the lower plate 3.

Figure 3:
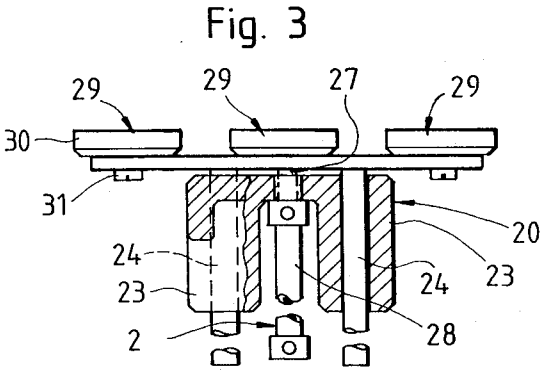
FIG. 3 is a side view of the magnet closing device along the seciton line III—III in FIG. 1.

On the carrier 2 there is also formed a bracket 20 which, in plan view, has an approximately trapezoidal design. According to FIG. 3, it has a cross-section like an inverted U. In the area of the free end of this bracket there is provided the clamping device 6. For this purposes the end of the bracket 20 has two parallel sliding bearings 23 in which guide bars 24, which bear a plate 25 at their upper ends, are mounted so as to be freely displaceable in the vertical direction. Centrally between these two sliding bearings 23 there is provided on the bracket 20 a closing drive 26 which is in the form of a pneumatically operable working cylinder and the piston rod 27 of which is connected to the plate 25 and the cylinder 28 of which is attached to the bracket 20. Mounted on the plate 25 are three permanent magnets 29 the arrangement of which corresponds to that of the three recesses 17.

Figure 4:
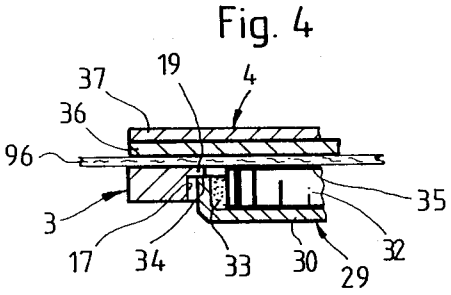
FIG. 4 is a partial view of the magnet closing device in its closed position corresponding to the detail IV in FIG. 1, on an enlarged scale.
Figure 2:
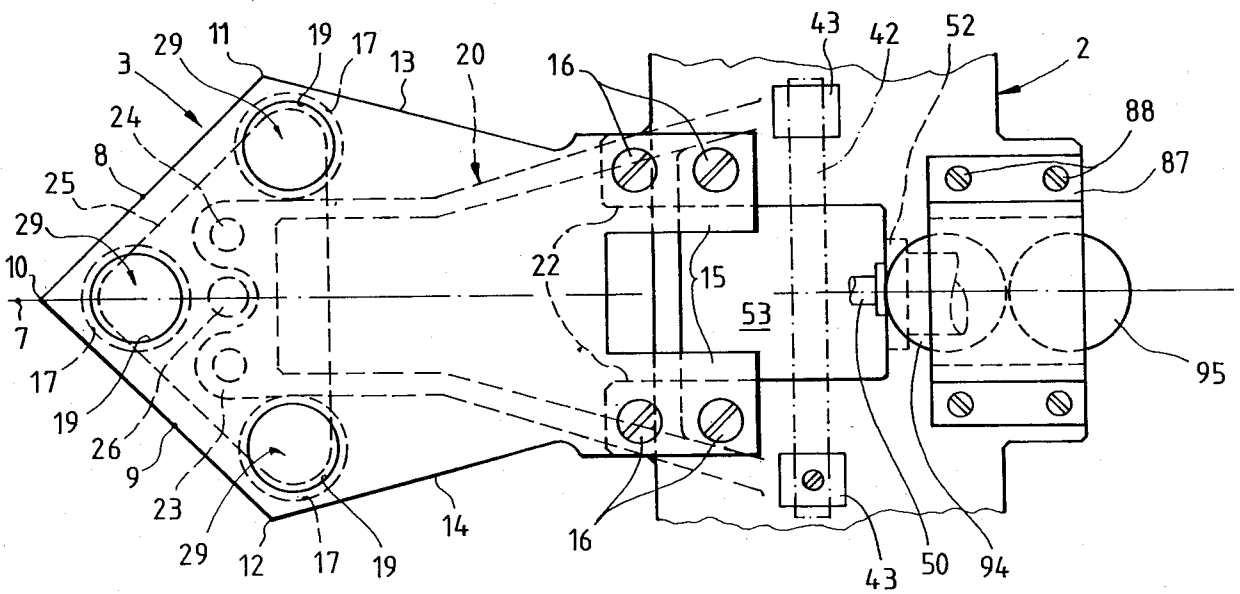
FIG. 2 is a plan view of the lower plate of the workpiece holder according to arrow II in FIG. 1.

As is evident from FIG. 4, the permanent magnets 29 each have a cup-shaped housing 30 which is fastened to the plate 25 by means of a screw 31. A cylindrical magnetic body 32 is secured in each cup-shaped housing 30 by means of a suitable binding agent 33. The cup-shaped housing 30 is so designed and has such a diameter that it can penetrate into each recess 17 and, at this point, its upper edge 34 comes into contact with the inwardly drawn edge 19 of the recess 17. The surface 35 of the magnetic body 32 projects over the edge 34 of the housing 30 so far as to be flush with the upper side 18 of the lower plate 3 if the housing 30 of the permanent magnet 29 bears with its edge 34 against the edge 19 of the recess 17. The stroke of the closing drive 26 is so dimensioned that, upon pneumatic actuation of the cylinder 28, the plate 25 is lifted to such a height that the permanent magnets 29 move into the described position as shown by dot-dash lines in FIG. 1.

The longitudinal displacing device 4 has a lower clamping plate 36 which is made of magnetic material, that is usually steel, and on which there are arranged an upper longitudinal sliding plate 37 made of non-magnetic material, that is for example high-alloy steel or brass. Also the longitudinal displacing device 4 is designed mirror-symmetrically with respect to the axis of symmetry 7. The sliding plate 37 has two flush oblong holes 39 which are in a flush arrangement one after another in their direction of longitudinal displacement 38, and which are each penetrated by a guide pilot 40 secured to the clamping plate 36. The guide pilots 40 are each provided with a flat cover 41 so that the longitudinal sliding plate 37 cannot be lifted from the clamping plate 36. The maximum distance by which the sliding plate 37 can be moved in the direction of displacement 38 is predetermined by the length of each of the oblong holes 39.

Figure 6:
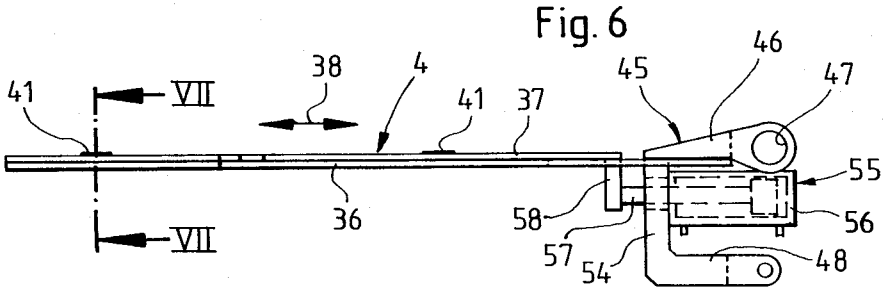
FIG. 6 is a side view of the longitudinal displacing device according to arrow VI in FIG. 5.
Figure 7:
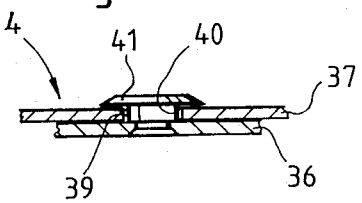
FIG. 7 is a partial section through the longitudinal displacing device along the section line VII—VII in FIG. 6.

The clamping plate 36 and thus the whole longitudinal displacing device 4 is pivotably mounted on the carrier 2. For this purpose an axle 42 is arranged on the carrier 2 extending transversely with respect to the axis of symmetry the two ends of this axis being rigidly retained in bearings 43 mounted on the carrier by means of a clamping screw 44. Attached to the clamping plate 36 is an—as is evident from FIG. 6—approximately C-shaped bearing element 45, the upper leg 46 of which has bearing bores 47 for receiving the axle 42. The lower leg 48 of the bearing member 45 is connected to a tilt drive 49. This linearly operating tilt drive 49 is in the form of a pneumatically actuatable cylinder, the piston rod 50 of which is connected to the free end of the lower leg 48. The cylinder 51 of the tilt drive 49 is secured to a web 52 on the carrier 2. In the carrier 2 there is formed a recess 53 through which the web 54 of the bearing member 45 connecting the two legs 46, 48 is guided. The web 54 is also guided between the two lugs 15 of the lower plate 3. By means of the tilt drive 49 the clamping plate 36 can, together with the sliding plate 37 resting thereon. be swung into a position as shown in FIG. 1, in which these plates are lifted from the lower plate 3. On the other hand, when the tilt drive 49 is correspondingly actuated pneumatically, the longitudinal displacing device 4 is swung downwardly so that the clamping plate 36 rests on and is approximately flush with the upper side 18 of the lower plate 3. On the web 54 of the bearing member 45 and approximately between the upper leg 46 and the lower leg 48 there is arranged a sliding drive 55 which is also in the form of a pneumatically actuatable cylinder. Its cylinder 56 is attached to the web 54 through which the piston rod 57 of the displacement drive 55 extends. The free end of the piston rod is connected to a downwardly angled extension 58 of the longitudinal sliding plate 37 so that, upon appropriate pneumatic actuation of the sliding drive 55, the longitudinal sliding plate is displaced in the described manner in the direction of longitudinal displacement 38. The displacement drive 55 follows the tilting movements of the longitudinal displacing device 4. The extension 58 is guided through a corresponding recess 59 in the clamping plate 36.

Figure 5:
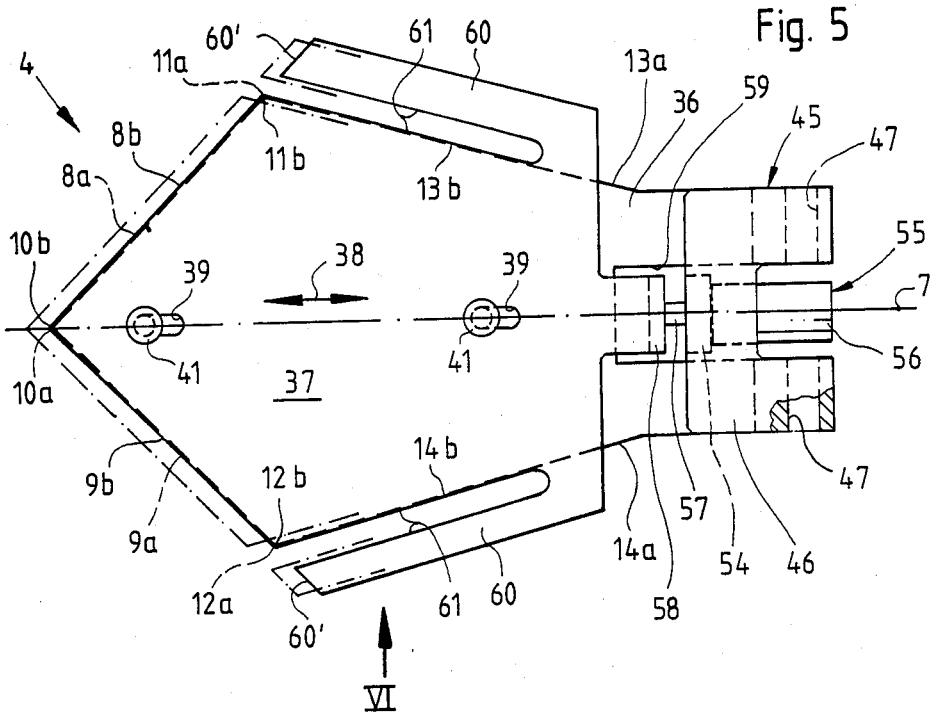
FIG. 5 is a plan view of the longitudinal displacing device according to arrow II in FIG. 1.

The clamping plate 36 has a profile outline corresponding approximately to that of the lower plate 3. It therefore also has two outer edges **8*a* and 9*a* terminating at a point 10*a*. Also the outer edges 8*a* and 9*a* meet in lateral corners 11*a*, 12*a*, respectively, forming the point of intersection with lateral edges 13*a*, 14*a*, respectively, which in turn run towards the axis of symmetry 7. There outer edges 8*a*, 9*a* and lateral edges 13*a* or 14*a* are shown by broken lines in FIG. 5**.

The longitudinal sliding plate 37 has outer edges **8*b*, 9*b* and lateral edges 13*b*, 14*b* which terminate at a point 10*b* and lateral corners 11*b*, 12*b*, respectively. When the slide plate 37 is in the retracted position shown in FIGS. 1, 5 and 6, the outer edges 8*b*, 9*b* are coincident with the outer edges 8*a*, 9*a* of the clamping plate 36. When the slide plate 37 is in the extended position shown in FIG. 5 by dot-dash lines, the lateral edges 13*b*, 14*b* are coincident with the lateral edges 13*a*, 14*a* of the clamping plate 36**.

Parallel to the lateral edges **13*b*, 14*b*, the slide plate 37 has a supporting section 60 between which section and the corresponding lateral edge 13*b*, 14*b* there is formed longitudinal recess 61 which is open in the area of each lateral corner 11*b*, 12*b***.

The centre folding device 5 has a plate-shaped tilt arm 62 which is pivotably mounted on the axle 42 by bearings 63. This tilt arm 62 has a section 64 which extends over the lower plate 3 or the displacing device 4 and to which are attached two folding plates 65, 66 which are formed mirror-symmetrically with respect to the axis of symmetry 7. These folding plates 65, 66 are mounted slidably on guide bars 67 extending transversely to the axis of symmetry 7 by means of sliding bearings 68. Each sliding bearing 68 is mounted on each folding plate 65 or 66. The guide bars 67 are in turn connected to the section 64 of the tilt arm 64 by means of appropriate holders 69. On the section 64 an angle lever 70 is in each case mounted pivotably about a bearing pin 71, over lever arm 72 of which lever is articulated on the sliding bearing 68 by means of an oblong hole connection 73. The other lever arm 74 of each angle lever 70 is connected to a folding drive 75. This folding drive 75 is in the form of a pneumatically actuatable cylinder, the cylinder 76 of which is mounted on a bearing surface 77 connected to the section 64 of the tilt arm 62. The piston rod 78 of the folding drive 75 is connected to the two other arms 74 of each angle lever 70 by means of a forked link 79. In order that the two identically designed angle levers 70 may project into the forked link 79, the lever arms 74 have at each end an offset corresponding to approximately half the thickness of the lever arms 74. Upon pneumatic actuation of the folding drive 75 the two folding plates 65, 66 are, by virtue of their kinematic connection with the folding drive 75, displaced transversely to the direction of displacement 38 simultaneously and symmetrically with respect to the symmetry axis 7, that is either into the adjacent position shown in unbroken lines in FIG. 8 or into the open position shown by dot-dash lines in FIG. 8. When in the closed position shown by unbroken lines in FIG. 8, the two folding plates 65, 66 are only slightly spaced from one another, i.e. their adjacent longitudinal edges 80, 81 leave only a small clear gap 82 therebetween. When the two folding plates 65, 66 are in the closed position, the outer edges **8*c* and 9*c* and the lateral edges 13*c* and 14*c* are substantially coincident with, respectively, the outer edges 8, 9 and lateral edges 13, 14. The folding plates 65, 66 have, on their underside facing the displacing device 4, adhering surfaces 65'** which are formed by roughening, corrugation, cellular rubber, sandpaper or the like and which therefore have a high coefficient of friction with respect to fabric.

Between the folding drive 75 and the axle 42 the section 64 of the tilt arm 62 has a recess 83 which is open towards one side and which extends approximately over the width of the folding plates 65, 66. The tilt arm 62 has a further section 84 which lies on the other side of the axle 42 and which is loaded by means of a pretensioned compression spring 85 which is supported against the carrier 2 and for this purpose is retained in an adapted recess 86 in the carrier 2. The compression spring 85 pressing against the underside of the section 84 therefore forces the tilt arm in such a direction that the folding plates 65, 66 are swung in the direction of the lower plate 3 or the longitudinal displacing device 4. In the area of the compression spring 85 a support 87 having approximately the shape of an inverted U is secured to the carrier 2 by means of screws 88. The section 84 projects through this support 87. Attached to the uppoer cross bar 89 of this support 87 are two pneumatically adjustable tilt stops 90, 91 for section 84 and thus the tilt arm 62. These tilt stops 90, 91 are each attached on the free end of a piston rod 92 or 93 of a pneumatically actuatable cylinder 94 or 95. The cylinders 94 or 95 are attached to the cross bar 89. The two cylinders 94 and 95 have different strokes a and b, respectively. The pneumatic cylinder shown on the left in FIG. 1 has the greater stroke a so that the tilt stop 90 connected thereto swings, when the piston rod 92 is extended, the tilt arm 62 in the position shown in FIG. 1 in which the folding device 5 is swung upwardly as far as possible. If both piston rods 92, 93 are retracted into corresponding cylinders 94, 95, then the compression spring 95—as already mentioned—forces the folding plates 65, 66 together with the displacing device 4 as far as and on to the lower plate 3. If, on the other hand, the piston rod 92 is in the retracted position together with the tilt stop 90 and if in this case the piston rod 93 is extended together with the tilt stop 91, then the folding plates 65, 66 are in an intermediate position between the position shown in FIG. 1 and the fully swung down position as mentioned in which the folding plates 65, 66 are lifted slightly from the longitudinal displacing device 4 resting against the lower plate 3.

Figure 8:
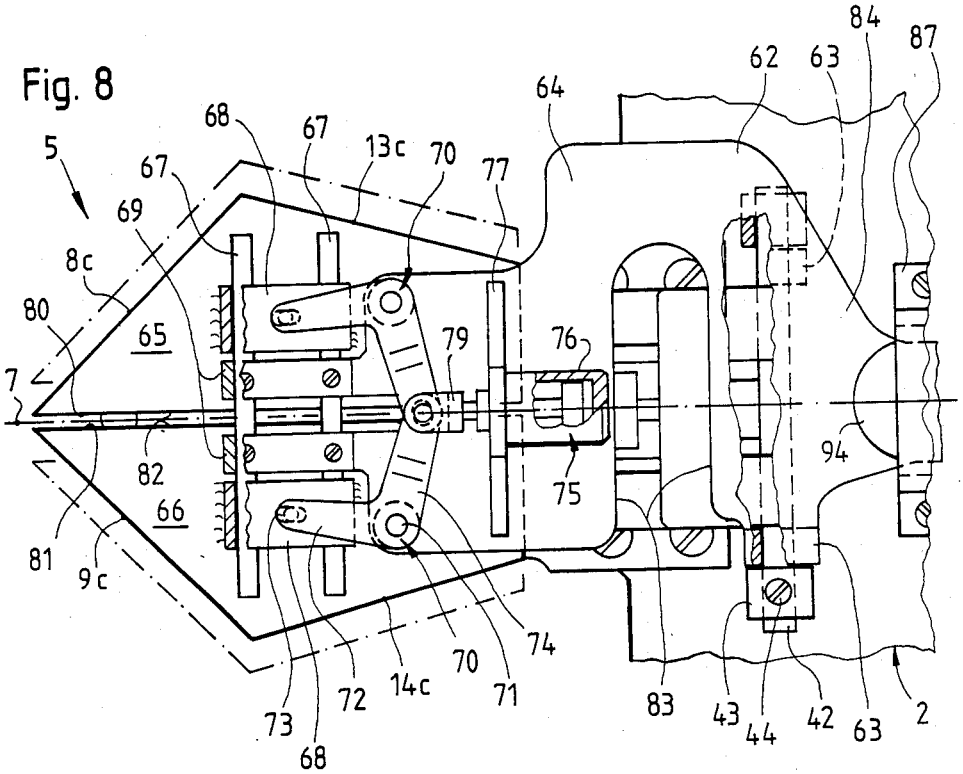
FIG. 8 is a plan view of the centre folding device according to arrow II in FIG. 1.
Figure 9:
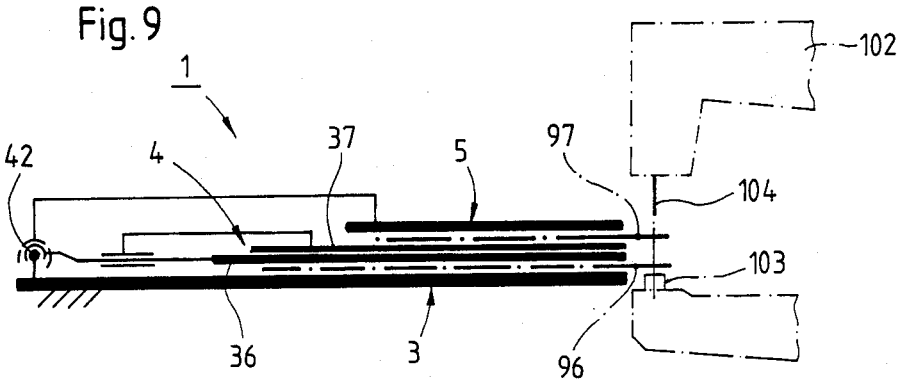
FIG. 9 is a diagrammatic lateral inverted view of the workpiece holder in the closed position during the sewing operation on a sewing machine.
Figure 10:
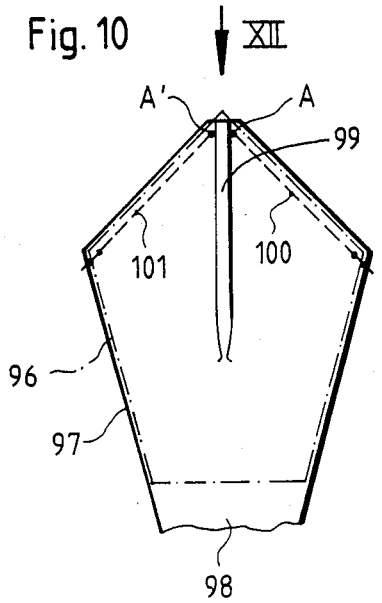
FIG. 10 is a plan view of a necktie cut and a lining cut during the first sewing stage.
Figure 11:
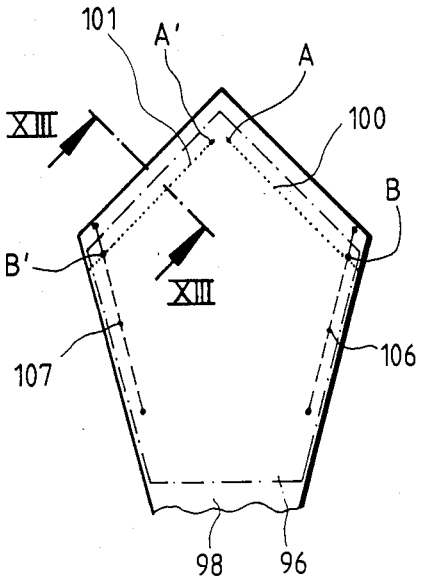
FIG. 11 is a plan view of the cuts according to FIG. 10 during a second sewing stage.

The mode of operation of this workpiece holder is as follows:

The starting position is shown in FIG. 1, the folding plates 65, 66 also being moved outwardly corresonding to the dot-dash lines in FIG. 8. First, a lining cut 96 is positioned on the lower plate 3. Subsequently, the longitudinal displacing device 4 is swung downwardly by appropriate actuation of the tilt drive 49 so that the lining cut 96 is clamped between the clamping plate 36 and the upper side 18 of the lower plate 3. Then, a necktie material cut 97 is positioned on the longitudinal displacing device 4, i.e. on the longitudinal sliding plate 37, the rearwardly tapering section 98 of the necktie cut 97 being guided through the recess 83 in the plate-shaped tilt arm 62. Subsequently, the tilt stop 90 which determines the inoperative position as shown by unbroken lines in FIG. 1 is moved upwardly by appropriate actuation of the cylinder 94 so that the compression spring 85 swings the centre folding device 5—in an inticlockwise direction in FIG. 1. Prior to this, the other tilt stop 91 was already in its upper position. The necktie material cut 97 is now clamped between the longitudinal sliding plate 37 and the two folding plates 65, 66. Then the two folding plates 65, 66 are pushed towards one another by appropriate actuation of the folding drive 75 so that their longitudinal edges 80 define only the narrow gap 82 therebetween. In this case a central fold 99 is formed in the necktie material cut 97 due to the effect of the adhering surfaces 65'. The so-called material fullness of the necktie cut 97 is received in this central fold 99, i.e. the surplus material is gathered here. Subsequently, the two cuts 96, 97 are connected to one another by means of an outer seam 100, 101 parallel to the outer edges 8, 9 or **8*a*, 9*a* or 8*b*, 9*b* or 8*c*, 9*c*. The workpiece holder 1 which is shown only diagrammatically in FIG. 9 is for this purpose guided past the sewing head 102 of a sewing machine in the manner normally practised in sewing, the outer edges 8 or 9 of the lower plate 3 being guided closely past the tubular stud 103 of the sewing head 102 so that the mentioned outer seams 100 or 101 can be produced by means of the needle 104. The outer seams 100 and 101 begin and end, respectively, at points A and A' directly next to the central fold 99**.

Figure 13:
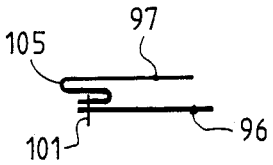
FIG. 13 is a partial cross-section through the cuts along the section line XIII—XIII in FIG. 11.
Figure 12:
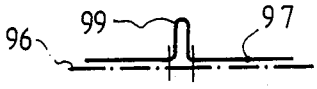
FIG. 12 is a view of the cuts according to arrow XII in FIG. 10.

Then the clamping device 6 is lifted so that the clamping plate 36 of the longitudinal displacing device 4 is clamped against the upper side 18 of the lower plate 3, whereby, as a result of the effect of the permanent magnets 29 on the clamping plate 36, the lining cut 96 is clamped firmly between the clamping plate 36 and lower plate 3. Then the folding plates 65, 66 are left in the position in which they are pushed towards one another, i.e. moved together, but are swung slightly upward. For this purpose the cylinder 95 is actuated so that the tilt stop 91 with the smaller stroke b bears against the section 84 of the tilt arm 82 and displaces the latter by a small amount so that the folding plates 65, 66 pass into the lifted position shown by broken lines in FIG. 1. Following this, the displacement drive 55 is actuated so that the sliding plate 37 is moved into the position shown by dot-dash lines in FIG. 5. The displacement of the centre folding devices 5 into its mentioned lifted position makes it possible for the previously mentioned material fullness from the central fold 105 to be consumed when the slide plate 37 is advanced into the position shown by dot-dash lines in FIG. 5. This is due to the fact that the necktie material cut 97, which is already connected to the lining cut 96 by the outer seams 100, 101, is positioned around the outer edges **8*b*, 9*b* of the advancing slide plate 37. The folding shown in FIG. 13 is achieved as a result, the necktie material cut 97 being provided with an outer fold 105 along the outer edges 8*b*, 9*b*. During this folding or advancing operation the ends 60' of the supporting sections 60 assist the formation of an undistroted, i.e. straight-lined outer fold 105. Because the permanent magnets 29 are used for the temporary clamping together of the lower plate 3 and clamping plate 36, i.e. for temporarily clamping the lining cut 96, the longitudinal displacing device 4 which consists essentially of the clamping plate 36 and longitudinal sliding plate 37, can have a very thin design so that the undesired formation of material fullness of the necktie cut 97 in the area of the outer edges 8*a*, 8*b*, 9*a*, 9*b* or lateral edges 13*a*, 13*b*, 14*a*, 14*b* is avoided. The permanent magnets 29 permit clamping of the lining cut 96 without the occurrence of transverse or lateral forces which bend the clamping plate 36 or sliding plate 37 so that even misalignment relative to the sewing plate is avoided. Displacement of the longitudinal slide plate 37 is easily possible because the magnetic clamping device 6 does not actuate the longitudinal slide plate 37, which is made of non-magnetic material, i.e. the slide plate 37 can be displaced largely without any friction occurring between it and the clamping plate 36. Then the pneumatic cylinder 95 is depressurized again so that the tilt stop 91 is moved upwardly. The compression spring 85 therefore again causes the necktie material cut 97 to be clamped on the longitudinal slide plate 37 by the folding plates 65, 66. The clamping device 6 is lowered, the closing drive 26 drawing the plate 25 together with the permanent magnets 29 downwardly in opposition to the action of force by the latter. The lateral seams 106, 107 which intersect the outer seams 100, 101 at points B and B', respectively, are produced parallel to the lateral edges 13, 14 so that there is no clear unsewn space between respective outer seams 100 and 101 and the associated lateral seams 106 and 107. Subsequently, the sewing head 102 is moved without sewing into its end position and the workpiece holder is opened. For this purpose the tilt stop 90 is moved downward so that the folding device 5 is swung into its uppermost position shown by unbroken lines in FIG. 1. At the same time the tilt drive 49 is actuated in such a manner that the longitudinal displacing device 4 is brought into its central position, also shown in FIG. 1. In this case the sewn tip are of the necktie is located on the displacing device 4 which has been lifted from the lower plate 3, and can be removed therefrom. Simultaneously with the movement of the sewing head 102 into its end position, the folding drive 75 and the sliding drive 55** are returned again into their starting position to enable a new work cycle to commence.

The central fold 99 extends almost as fas as the end of the lateral seams 106, 107. The material fullness of the necktie cut 97 which is drawn into the central fold 99 determines the degree of retraction of the outer seams 100, 101.

What is claimed is:

1. Workpiece holder for sewing the area of a tip of a necktie, comprising a lower plate as a support for a lining cut, and comprising a center folding device to be supported on a necktie material cut to be arranged above the lining out, the center folding device having two folding plates which can be adjusted in opposite directions to one another and transversely with respect to a longitudinal direction of the cuts and by means of which a material fullness of the necktie material cut can be drawn into a gap between the folding plates to form a central fold, and the center folding device being pivotable upwardly from the lower plate or towards the lower plate, and the two cuts being connectable to one another, when the central fold is gathered, by means of two outer seams extending towards the tip and by means of lateral seams following these outer seams, wherein between the lower plate and the center folding device a longitudinal displacing device with a longitudinal sliding plate is arranged, between which plate and the centre folding device the necktie material cut is to be arranged, and wherein the longitudinal displacing device is displaceable after the sewing of the outer seams and before the sewing of the lateral seams while the central fold is drawn out of the gap and outer folds are formed parallel to the outer seams.

2. Workpiece holder according to claim 1, wherein the longitudinal displacing device has a clamping plate below the longitudinal sliding plate for clamping the lining cut to the lower plate.

3. Workpiece holder according to claim 2, wherein the clamping plate can be clamped against the lower plate by means of a clamping device arranged below the lower plate.

4. Workpiece holder according to claim 3, wherein the clamping device is provided with retaining heads.

5. Workpiece holder according to claim 3, wherein the clamping device is provided with magnets and the clamping plate is made from magnetic material.

6. Workpiece holder according to claim 5, wherein the magnets are in the form of permanent magnets and the clamping device is designed to be movable towards the lower plate.

7. Workpiece holder according to claim 5, wherein the longitudinal sliding plate is made of non-magnetic material.

8. Workpiece holder according to claim 1, wherein the longitudinal sliding plate can be displaced by means of a sliding drive.

9. Workpiece holder according to claim 1, wherein the longitudinal displacing device can be pivoted by means of a pivoting drive.

10. Workpiece holder according to claim 1, wherein the centre folding device can be swung upwardly into two positions.

11. Workpiece holder according to claim 10, wherein the centre folding device can be swung upwardly towards at least one adjustable swing stop.

* * * * *